United States Patent [19]

Selwood et al.

[11] 4,097,203

[45] Jun. 27, 1978

[54] RECIPROCATING PISTON PUMP

[75] Inventors: Timothy John Selwood, Minstead, near Cadnam; Martin John Shelley Axtell, Lymington; John David Burton, St. Mary Bourne, near Andover, all of England; Peter Richard Selwood, deceased, late of Southampton, England; by Timothy John Selwood, executor, Minstead, near Cadnam; by Martin John Shelly Axtell, executor, Lymington, both of England

[73] Assignee: William R. Selwood Limited, Eastleigh, England

[21] Appl. No.: 676,884

[22] Filed: Apr. 14, 1976

[30] Foreign Application Priority Data

| | | |
|---|---|---|
| Apr. 15, 1975 | United Kingdom | 15368/75 |
| Mar. 6, 1976 | United Kingdom | 9070/76 |

[51] Int. Cl.[2] ..... F04B 43/02; F04B 21/04

[52] U.S. Cl. ..... 417/480; 417/525

[58] Field of Search ..... 417/523, 534, 413, 473, 417/479, 480; 74/55

[56] References Cited

U.S. PATENT DOCUMENTS

| | | | |
|---|---|---|---|
| 1,818,413 | 8/1931 | Luitwieler | 417/534 |
| 2,697,403 | 12/1954 | Benedek | 74/55 |
| 2,962,904 | 12/1960 | Soccart | 74/55 |
| 3,307,492 | 3/1967 | Selwood et al. | 417/244 |

*Primary Examiner*—William L. Freeh

*Attorney, Agent, or Firm*—Spencer & Kaye

[57] ABSTRACT

A pump having a body including at least two axially aligned pumping chambers each of which contains an actuator having a main central rigid portion and a peripheral sealing ring retained in a clearance space and under radial compression in non-sliding fluid-tight relation between the main central portion and a lateral wall of the pumping chamber, such main central portions of the actuators being joined by a rigid connecting rod having further sealing rings embracing it and engaged with the side walls of respective pumping chambers to form a resiliently supported unit which is reciprocable axially of the pumping chambers and is driven by provision of contact faces on the connecting member spaced apart along said axis and facing in opposite directions, and between which is received the outer race of an anti-friction bearing carried on an eccentric of a drive spindle mounted for rotation in the pump body at right angles to the pumping chamber axis.

8 Claims, 5 Drawing Figures

RECIPROCATING PISTON PUMP

BACKGROUND OF THE INVENTION

1. Field of the Invention

This invention relates to pumps (hereinafter referred to as being of the kind specified) each such pump comprising a body having at least two axially aligned pumping chambers each communicating at its opposite ends respectively with a pump inlet and a pump outlet, an actuator in each pumping chamber reciprocable longitudinally of the axis of the chambers, each actuator having a relatively rigid main central portion and a peripherally extending elastic sealing ring retained in a clearance space and in non-sliding fluid-tight engagement between the main central portion and a lateral wall of the pumping chamber, valve means for each actuator controlling the flow of fluid therethrough from the inlet to the outlet, and drive means for reciprocating the actuators.

2. Description of the Prior Art

In our prior U.S. Pat. No. 3,307,492, the actuators were driven from a rotary crank each through the intermediary of a connecting rod secured through a non-flexing, i.e. rigid, joint to the main central portion of the actuator, and at its other end driven orbitally by connection to an eccentric or crank driven from the prime mover. The connecting rod also passed through a sealing ring embracing the connecting rod and having its outer periphery engaged in a fluid-tight manner with the side wall of the pumping chamber.

In this arrangement both the sealing ring of the actuator and the sealing ring of the connecting rod were stressed in a complex manner by the angular displacement of the connecting rod and, although pumps constructed in this manner have operated satisfactorily with long service lives for the sealing rings concerned, such sealing ring are subjected, due to the relatively high frequency of operation (motor speed typically being 1500 r.p.m.), to conditions of operation which can produce fatigue failures unless the composition of the material of the sealing rings and their cross-sectional shape and dimensions are all carefully controlled.

SUMMARY OF THE INVENTION

One of the principal objects of the present invention is to provide less arduous conditions of operation for the sealing rings and thereby lengthen still further the effective service life of the sealing rings and/or provide a relaxation of the critical parameters of composition and cross-sectional shape and dimensions.

Predominantly such pumps have found application in handling liquids which contain a significant proportion of solid state matter in suspension, e.g. such pumps have been used extensively for drainage purposes in excavations at civil engineering or building sites.

Such pumps may, however, be advantageously applied in industrial applications where fluids, especially but not exclusively liquid fluids, are required to be handled in large scale chemical and physical treatment plants.

Long service life is especially important in these applications since the pumps cannot be taken out of service at frequent intervals for replacement of components and the nature of the fluids handled in many cases still further limits the composition of the material from which the sealing rings are required to be formed in order to avoid destructive reaction between the liquid and the seals and contamination of the liquids undergoing handling.

With these objects in view, there is provided in accordance with one aspect of the present invention a pump comprising a body including at least two pumping chambers aligned along an axis, each of said chambers communicating at its opposite ends respectively with a pump inlet and a pump outlet, an actuator in each pumping chamber reciprocable longitudinally of said pumping chamber axis, each actuator having a relatively rigid main central portion and a peripherally extending elastic sealing ring retained in a clearance space and in non-sliding fluid-tight engagement between said main central portion and a lateral wall of said pumping chamber, valve means for each of said actuators controlling the flow of fluid through an associated one of said chambers from said inlet to said outlet, and drive means for reciprocating said actuators, said pump including the improvement wherein a connecting member is provided extending between and joining said main central portions of said actuators and forming with said main central portions a substantially rigid unit, said unit is supported for movement along said pumping chamber axis by resilient means including at least said sealing rings, said drive means includes a rotary member mounted for rotation about a drive axis and having a part moved eccentrically with respect to said drive axis, said drive means further includes means for transmitting motion to said connecting member from said rotary member in the form of reciprocation along said pumping chamber axis and comprising contact faces presented in opposite directions along said pumping chamber axis, said contact faces being of a form substantially to eliminate transmission of forces to said connecting member in a direction laterally of said pumping chamber axis.

It would be within the scope of the invention for the contact faces to be formed on the part of the rotary member which is moved eccentrically about the drive axis and for a roller or bearing race to be provided on the connecting member for reception between these faces. Preferably, however, the contact faces are on the connecting member and are spaced apart axially thereof, and the eccentrically moved part of the rotary member is received between the contact faces. The rotary member may thus be of circular form in a plane at right angles to the drive axis, and may have a diameter which is equal to, or only slightly less than, the axial spacing between the contact faces.

The sealing rings of the actuators and any sealing rings embracing the connecting member and supported and sealed at their outer peripheries with respect to the side walls of the pumping chambers respectively are thus relieved of the strains due to lateral and/or angular displacement of the connecting member since the latter is reciprocated solely along the axis of the pumping chambers.

A further object of the present invention is to facilitate maintenance by providing an arrangement of drive means, principal parts of which are contained in a drive chamber which can contain lubricant if required and from which the drive means may readily be removed without disassembly of other major components of the pump and in particular without draining the pump of the fluid undergoing pumping.

Thus, according to a further aspect of the invention, we provide a pump comprising a body including at least two pumping chambers aligned along an axis, each of said chambers communicating at its opposite ends respectively with a pump inlet and a pump outlet, an actuator in each pumping chamber reciprocable longitudinally of said pumping chamber axis, each actuator having a relatively rigid main central portion and a peripherally extending elastic sealing ring retained in a clearance space and in non-sliding fluidtight engagement between said main central portion and a lateral wall of said pumping chamber, valve means for each of said actuators controlling the flow of fluid through an associated one of said chambers from said inlet to said outlet, and drive means for reciprocating said actuators, said pump including the improvement wherein a connecting member is provided connected to and extending between said main central portions of said actuators, said drive means includes a rotary member mounted for rotation about a drive axis and having a part moved eccentrically with respect to said drive axis, said part and said connecting member interfit with each other for transmission of reciprocatory movement to said connecting member while being releasable along a withdrawal path extending longitudinally of said drive axis, mounting means are provided for said rotary member comprising a carrier, bearing means carried thereby at the side of said connecting member facing towards said withdrawal path, and means for releasably securing said carrier to said body to permit, on release of said securing means, withdrawal of said carrier, bearing means, and rotary member from said body. Preferably said part of said rotary member and an intermediate portion of said connecting member with which said part interfits as aforesaid are contained in a drive chamber situated intermediate the inner ends of said axially aligned pumping chambers, and said inner ends of said axially aligned pumping chambers are sealed with respect to outflow of the fluid to be pumped by respective sealing rings embracing respective end portions of said connecting member.

BRIEF DESCRIPTION OF THE DRAWINGS

Embodiments of the present invention will now be described, by way of example, with reference to the accompanying drawings wherein.

DESCRIPTION OF THE PREFERRED EMBODIMENTS

Figure 1:
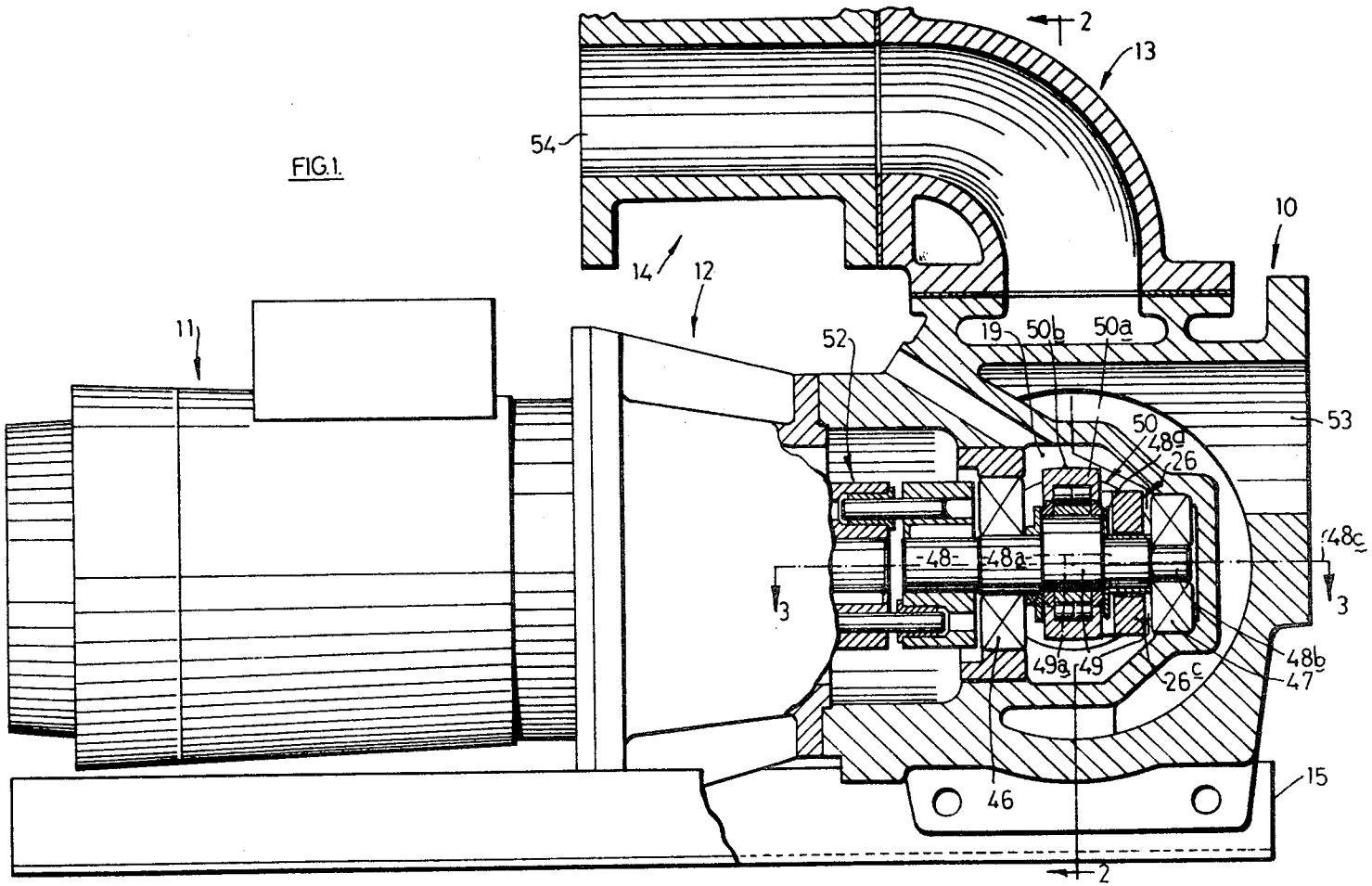
FIG. 1 is a view in side elevation and partly in vertical cross-section through one embodiment of pump in accordance with the invention.

The pump illustrated comprises the following main units, namely a pumping chamber and delivery manifold unit 10, a drive motor 11, a drive unit 12 serving to transmit drive from the motor 11 to a connecting member and thence to the actuators of the main unit 10, fluid delivery units 13 and 14, and a supporting base 15.

Figure 2:
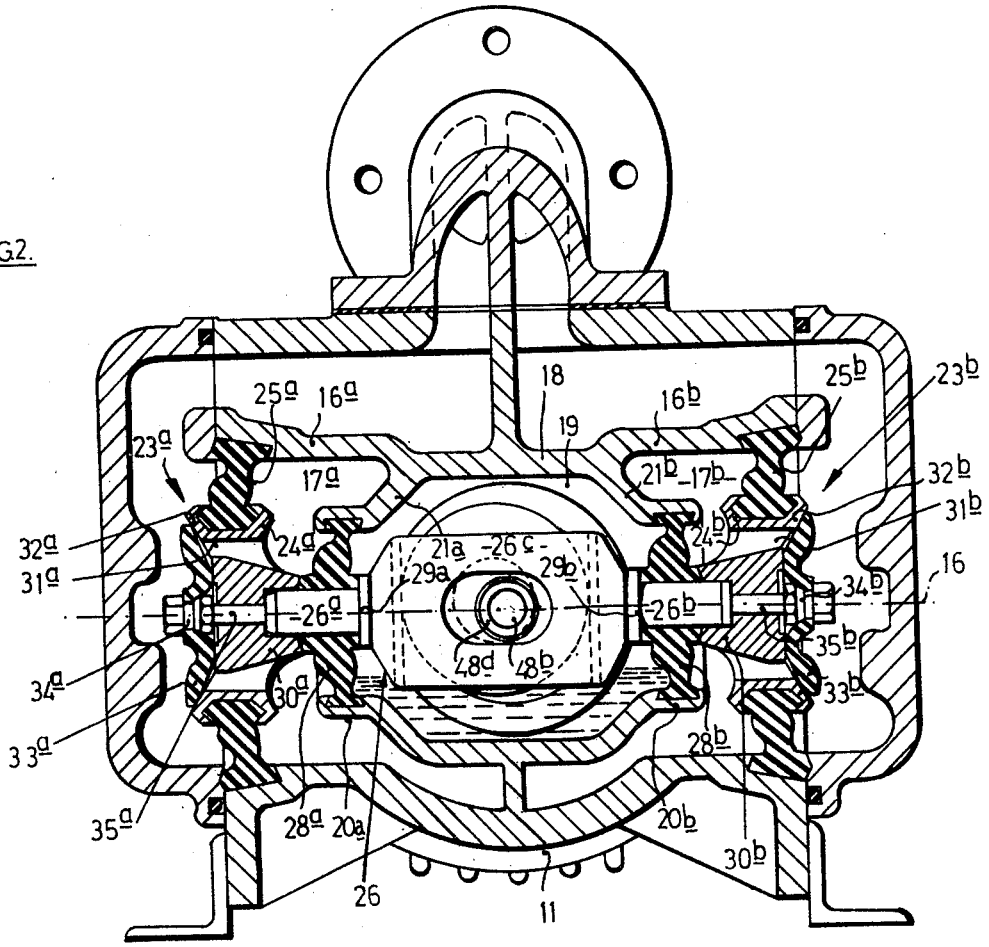
FIG. 2 is a view in end elevation and in vertical cross-section on the line 2—2 of FIG. 1.

Referring specifically to the main pumping chamber and manifold unit 10, this incorporates, as shown in FIG. 2 two cylindrical portions **16*a*, 16*b* forming the side walls of respective pumping chanbers 17*a*, 17*b* and integrally connected with each other by a central cylindrical portion 18 forming the lateral boundary of a chamber 19** between the two pumping chambers.

Within the two pumping chambers are mounted sleeves **20*a*, 20*b* connected by webs 21*a*, 21*b*** to the side walls of the pumping chambers at the inner ends of the latter.

The pumping chambers contain actuators **23*a*, 23*b* movable along the axis 16 of the pumping chambers and comprising rigid main central portions 24*a*, 24*b* and peripherally extending sealing rings 25*a*, 25*b*** which have attachment portions seated in annular recesses in the peripheral faces of the main central portions and in the side walls of the pumping chambers respectively so as to establish a non-sliding but fluid-tight relationship. The sealing rings are of radial dimensions such as to ensure that they are maintained in radial compression in the clearance space between the main central portions of the actuators and the side walls of the associated pumping chambers respectively throughout the strokes of the actuators.

The actuators are joined to each other by a connecting member 26 having end portions **26*a*, 26*b* received in sockets afforded by the main central portions of respective actuators. The end portions 26*a*, 26*b* are sealed with respect to the pumping chambers concerned by sealing rings 28*a*, 28*b* which are also under radial compression and have inner attachment portions compressed between shoulders 29*a*, 29*b* on the connecting member and opposing end faces of bosses 30*a*, 30*b* while the outer attachment portions of these sealing rings are received in recesses in the supporting sleeves 20*a*, 20*b*. A possible modification to facilitate assembly is shown in FIG. 3A as applied to the supporting sleeve 20*a* and in which such sleeve is split into two components 55*a*, 56*a* defining an undercut or dove-tail-shaped recess of annular form for reception of the outer peripheral margin of the associated sealing ring 28*a*. Further, to facilitate assembly such undercut or dove-tailed recess may be defined at one at least of its axial boundaries by a structurally separate sealing ring 57*a*. The split components 55*a*, 56*a* may be secured in any suitable manner as, for example, by means of flange portions formed on each of them and bolts coupling flange portions together. A similar construction may be adopted for the sleeve 20*b*** if desired.

The sealing rings are of a form collectively to provide strong centering action, i.e. resist displacement of the unit comprising the actuators and connecting rod in a direction radially of the axis 16 but permit of high speed flexure perpendicular to their own planes along the axis 16.

Associated with each actuator is an actuator valve comprising apertures **31*a*, 31*b* extending axially through the main central portion, annular valve seatings 32*a*, 32*b* on the downstream face of each such portion, and flap valve elements 33*a*, 33*b* overlying these apertures and engaging the valve seatings, the flap valve elements being retained by mounting bushes 34*a*, 34*b* screwing onto threaded end portions of pins 35*a*, 35*b* integral with the end portions 26*a*, 26*b***. The flap valve elememts may be bonded to these bushes.

Referring now to the drive means, the driving motor 11 may be either an electric motor or an internal combustion engine. In the former case the electric motor will ordinarily be an alternating current induction motor adapted to run at a predetermined speed, for example about 1500 r.p.m., when energised from a 50 Hz a.c. supply.

Figure 3:
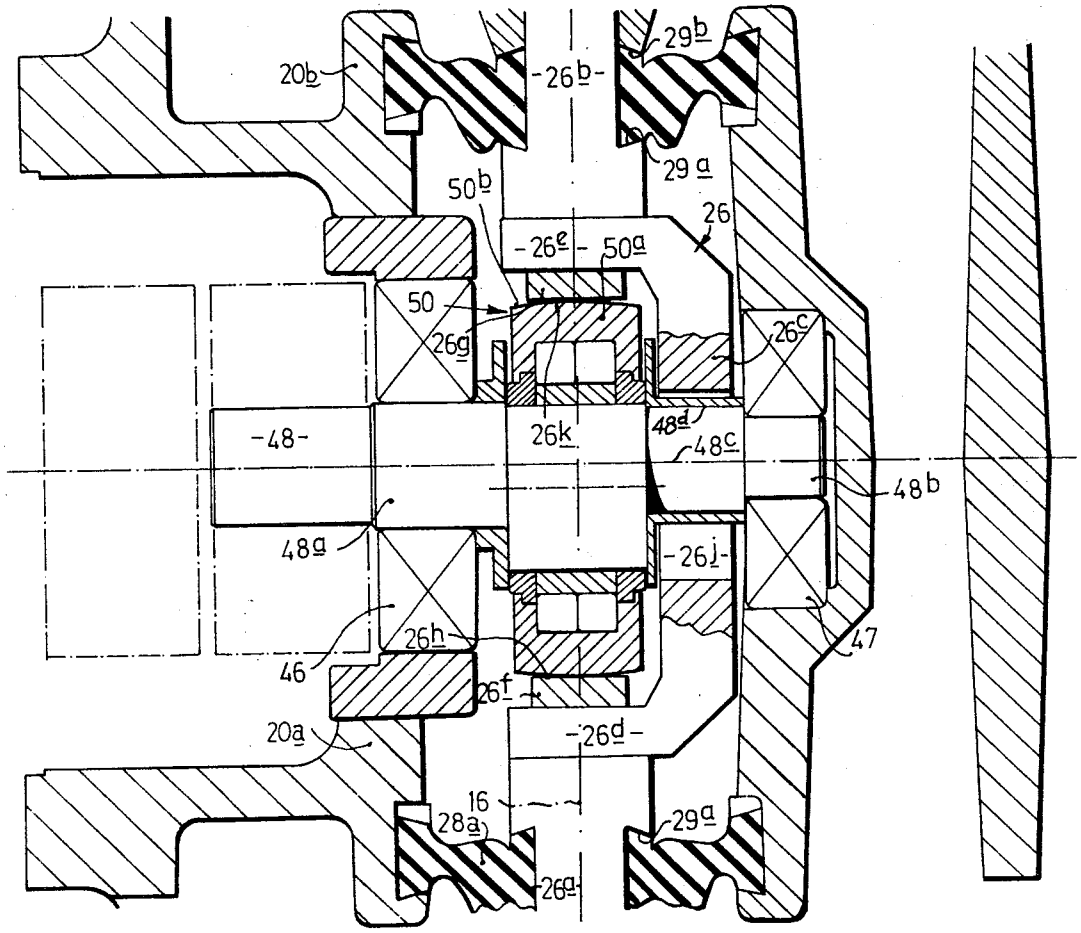
FIG. 3 is a fragmentary view in plan and in cross-section on the line 3—3 of FIG. 1.
Figure 3A:
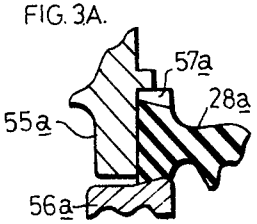
FIG. 3A is a fragmentary view in cross-section on the line A—A of FIG. 3 illustrating a modification of the portion of the pumping chamber supporting the connecting rod seal.

The drive means comprises, as appears in FIGS. 1 and 3 a drive spindle 48 having journal portions 48*a*, 48*b* supported in bearings 46 and 47 at opposite ends of the chamber 19, said spindle being rotatable about a drive axis 48*c* and connected to the motor through a releasable coupling 52.

Intermediate the journal portions 48*a*, 48*b* the spindle incorporates a crank pin or eccentric 49 of cylindrical form centered on an axis 49*a* and carrying a roller bearing 50 the outer race 50*a* of which has an outer surface 50*b* which is crowned (spherically).

The connecting member 26 has an intermediate portion 26*c* which is cranked or offset laterally from the axis 16 of the pumping chambers on which the end portions 26*a*, 26*b* are centered, this offset portion 26*c* being connected with the end portions through webs 26*d*, 26*e*, as shown in FIG. 3. The inner faces of the webs carry liner elements 26*f*, 26*g* which at their inwardly presented sides have planar contact faces 26*h*, 26*k* lying in planes at right angles to the axis 16 and extending vertically for a sufficient distance to ensure that in all positions of rotation of the spindle contact will be maintained between the crowned surfaces 50*b* and one or the other of the contact surfaces 26*h*, 26*k*. The liner elements may be made of a metallic material which provides good wearing properties in combination with the steel outer race 50*a* of the bearing 50.

Although the drive means operates substantially to eliminate the transmission of forces to the connecting member 26 laterally of the axis 16, i.e. radially thereto in any direction, it is assumed that there may still be a very slight yaw angle of the connecting member with respect to the axis 16 due to various factors such, for example, as asymmetrical loading of the actuators by the fluid undergoing pumping, dimensional and composition tolerances of the sealing rings. Consequently it is desirable that the spacing along the axis 16 between the contact faces 26*h*, 26*k* be such as to provide a minimum clearance with respect to the crowned surface 50*b* of the outer race of the bearing 50 as given by the following equation.

$$\delta = \frac{(Rc - R)^2}{Rc} \sin^2\alpha$$

where $\delta$ = the diametral clearance.

Rc = radius of crowning of the outer surface 50*b* of the outer race.

R = radius of outer race in contact with connecting member contact faces.

$\alpha$ = maximum angle of yaw experienced by the connecting member (FIG. 3) in its elastic support, i.e. angle between the pumping chamber axis and connecting member axis in the plane containing the pumping chamber axis 16 and the drive axis 48*c*.

The offset portion 26*c* of the connecting member affords an opening 26*j* of dimensions to provide clearance both in the vertical direction and in the horizontal direction with respect to a flanged sleeve 48*d* carried by the portion of the spindle 48 which passes through such opening with clearance being maintained in all positions of travel of the connecting member.

In operation rotation of the spindle 48 produces reciprocating motion of the unit comprising the main central portions 24*a*, 24*b* of the actuators and the connecting member 26, this unit being supported resiliently by the sealing rings 25*a*, 25*b* and 28*a*, 28*b*. Flow of fluid through the pump occurs, such fluid entering an inlet 53 communicating with the pumping chambers 17*a*, 17*b* at the upstream sides of the actuators, passing therethrough to the downstream sides and being delivered from the pumping chambers through duct sections 13 and 14 to an outlet 54.

Figure 4:
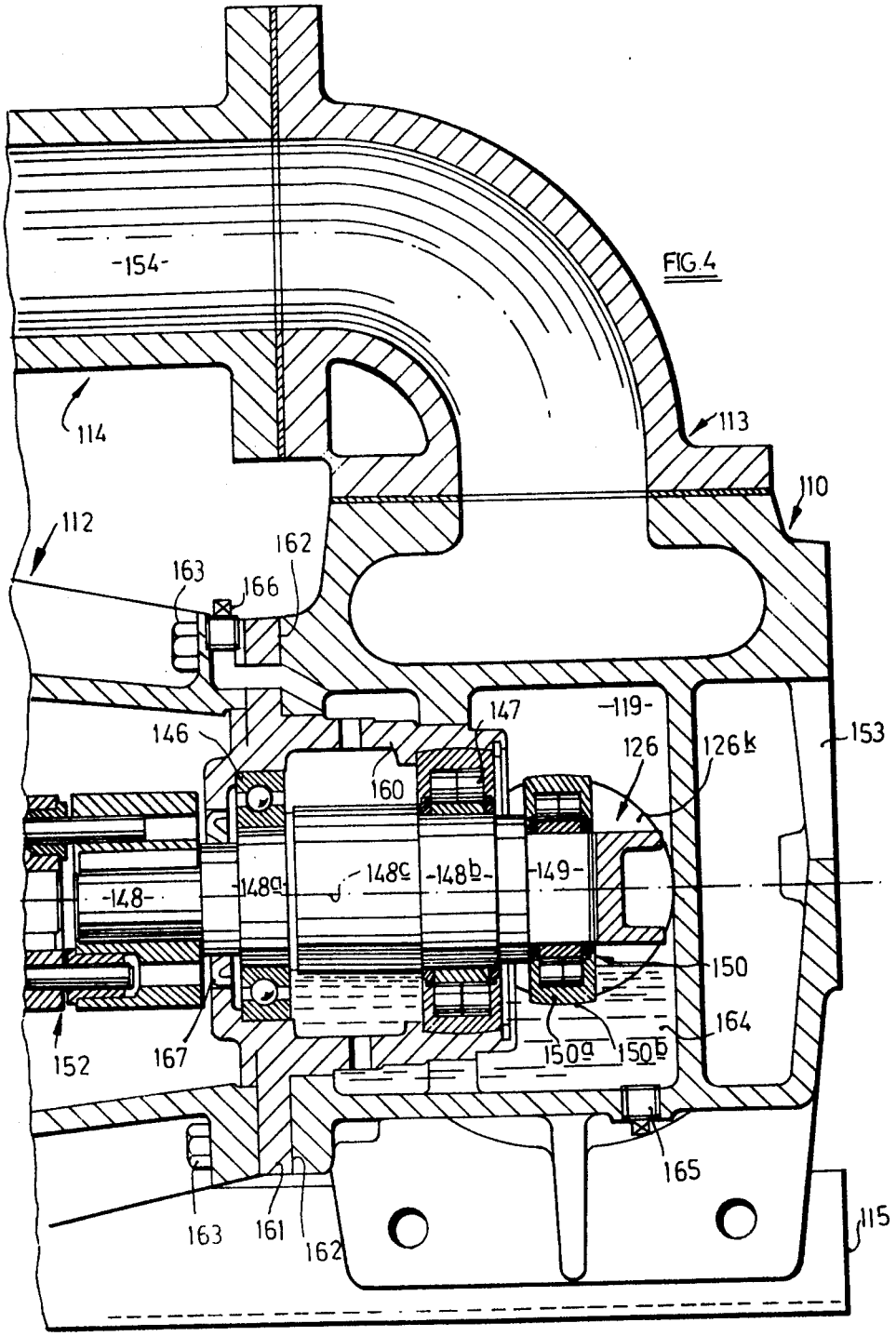
FIG. 4 is a fragmentary view corresponding to FIG. 1 illustrating a further embodiment of pump in which the driving spindle in withdrawable axially from assembled relation with the connecting member.

In the embodiment shown in FIG. 4 parts corresponding to those already described are designated by like references with the prefix 1 to which the preceding decription will be deemed to apply, reference now being made to the principal modifications. Instead of supporting the spindle 148 by axially spaced bearings one on each side of the connecting member 126, both supporting bearings 146 and 147 are housed in a sleeve-like carrier 160 and are situated at the same side of the connecting member 126. The carrier 160 has a flange 161 clamped between the drive unit 112 and a facing 162 on the pump body and is secured releasably by bolts 163. The bearing 150 mounted on the eccentric 149 which operates between contact spaces spaced apart axially along the pumping chamber axis such as the contact face 126*k* is withdrawable along the drive axis 148*c* in a direction towards the aperture in the drive chamber 119 normally closed by the carrier 160. Thus, such withdrawal can be effected merely upon removal of the bolts 163 amd without disassembling other parts of the pump. The chamber 119 may contain a lubricant such as oil 164 which can be drained and replenished through openings normally closed by plugs 165, 166. Suitable sealing means such as sealing ring 167 is provided in the carrier to prevent leakage of oil from the drive chamber 119.

We claim:

1. In a pump composed of a body including at least two pumping chambers aligned along an axis, each of said chambers communicating at its opposite ends respectively with a pump inlet and a pump outlet, two actuators each disposed in a respective pumping chamber and reciprocable longitudinally of the pumping chamber axis, each actuator having a relatively rigid main central portion and a peripherally extending elastic sealing ring retained in a clearance space in non-sliding fluid-tight engagement between the main central portion and a lateral wall of the pumping chamber, valve means for each of the actuators controlling the flow of fluid through an associated one of the chambers from th inlet to the outlet, and drive means for reciprocating the actuators, the improvement wherein:

a. said pump further comprises a connecting member extending between, and joining, said main central portions of said actuators and forming with said main central portions a substantially rigid unit;

b. said unit is supported, for movement along said pumping chamber axis, solely by resilient means including at least said sealing rings and providing greater resistance to displacement of said unit in a direction radial to said pumping chamber axis than to displacement longitudinally of said pumping chamber axis, to provide for high speed reciprocation of said unit;

c. said connecting member is provided with contact faces presented in opposite directions towards one another along said pumping chamber axis, said contact faces being of planar form and extending at right angles to the pumping chamber axis;

d. said drive means includes a rotary member mounted for rotation about a drive axis and having a part moved eccentrically with respect to said drive axis;

e. said eccentrically moved part is of circular form in a plane at right angles to said drive axis and is received between said contact faces, the diameter of said eccentrically moved part being only slightly less than the axial spacing between said contact faces;

f. said eccentrically moved part comprises a bearing having inner and outer races and intermediate rolling elements; and g. said outer race as a peripherally extending outer surface which is crowned.

2. A pump according to claim 1 wherein the diameter of said crowned surface of said outer race relative to said axial spacing between said contact faces of said connecting member is such as to provide a clearance space having a minimum value equal to the ratio of the square of the difference between the radius of crowning of said crowned surface and the radius from said drive axis to said outer surface, to the radius from said drive axis to said outer surface, multiplied by the square of the sine of the maximum angle of yaw of said connecting member.

3. A pump according to claim 1 wherein said connecting member has a portion intermediate its ends which is offset or cranked laterally with respect to end portions of said connecting member, and said contact faces are formed on junction parts connecting said end portions with said intermediate portion.

4. A pump according to claim 1 wherein said resilient means supporting said connecting member further comprises sealing rings embracing end portions of said connecting member and having their outer peripheries supported from side walls of respective pumping chambers.

5. A pump according to claim 1 wherein:

a. said rotary member of said drive means is supported for rotation in bearings spaced apart axially along said drive axis, b. said bearings are mounted in said pump body at opposite sides of said connecting member, c. said connecting member has an opening of dimensions to provide clearance with respect to a portion of said rotary member passing therethrough.

6. A pump according to claim 1 wherein:

a. said rotary member is releasable from said connecting member along a withdrawal path extending longitudinally of said drive axis; and b. said pump further comprises mounting means for said rotary member includng a carrier, bearing means carried thereby at the side of said connecting member facing towards said withdrawal path, and means for releasably securing said carrier to said body to permit, on release of said secuting means, withdrawal of said carrier, bearing means, and rotary member from said body.

7. A pump according to claim 6 wherein:

a. said part of said rotary member and an intermediate portion of said connecting member with which said part interfits as as aforesaid are contained in a drive chamber situated intermediate the inner ends of said axially aligned pumping chambers, b. said inner ends of said axially aligned pumping chambers are sealed with respect to outflow of the fluid to be pumped by respective sealing rings embracing respective end portions of said connecting member.

8. A pump according to claim 7 wherein said drive chamber is open only at the side thereof towards which said withdrawal path extends from said connecting member, and said carrier is assembled to close said opening.

* * * * *

UNITED STATES PATENT AND TRADEMARK OFFICE

CERTIFICATE OF CORRECTION

PATENT NO. : 4,097,203

DATED : June 27th, 1978

INVENTOR(S) : Peter Richard Selwood et al

It is certified that error appears in the above-identified patent and that said Letters Patent are hereby corrected as shown below:

Column 7, line 27, change"from said drive" to --of said outer race--; change line 28 to read: --to said crowning radius of said--; line 29, change "axis to said outer" to --crowned-- and before "multiplied" insert --all--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*